US010978261B2

(12) United States Patent
Lai et al.

(10) Patent No.: US 10,978,261 B2
(45) **Date of Patent: *Apr. 13, 2021**

(54) METHOD FOR FABRICATING KEYBOARD COVERING FILM

(71) Applicant: Darfon Electronics Corp., Taoyuan (TW)

(72) Inventors: Zheng-Hong Lai, Taoyuan (TW); Chih-Ho Hsu, Taoyuan (TW); Che-Wei Lee, Taoyuan (TW); Jin-Long Chan, Taoyuan (TW); Yuan-bao Chen, Taoyuan (TW); Chang-En Sun, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/897,384

(22) Filed: Jun. 10, 2020

(65) Prior Publication Data

US 2020/0303141 A1 Sep. 24, 2020

Related U.S. Application Data

(63) Continuation of application No. 15/971,021, filed on May 4, 2018, now Pat. No. 10,770,246.

(30) Foreign Application Priority Data

May 8, 2017 (TW) ..... 106115177

(51) Int. Cl.
*H01H 13/86* (2006.01)
*H01H 13/705* (2006.01)
*H01H 13/06* (2006.01)

(52) U.S. Cl.
CPC ..... *H01H 13/86* (2013.01); *H01H 13/06* (2013.01); *H01H 13/705* (2013.01);
(Continued)

(58) Field of Classification Search
CPC ..... H01H 13/86; H01H 13/06; H01H 13/705
(Continued)

(56) References Cited

U.S. PATENT DOCUMENTS 5,677,007 A 10/1997 Tsai
9,229,537 B2 1/2016 Chen et al.
(Continued)

FOREIGN PATENT DOCUMENTS

CN 101657075 A 2/2010
CN 201594484 U 9/2010
(Continued)

OTHER PUBLICATIONS

TIPO Notice of Allowance dated Sep. 20, 2017 in corresponding Taiwan application (No. 106115177).
(Continued)

*Primary Examiner* — Edwin A. Leon
*Assistant Examiner* — Iman Malakooti
(74) *Attorney, Agent, or Firm* — McClure, Qualey & Rodack, LLP

(57) ABSTRACT

A method for fabricating a keyboard covering film is provided. The method includes steps of: coating a transparent plastic material on an upper surface of a fabric layer before the transparent plastic material is cured; treating the fabric layer and the transparent plastic material by a hot press process to cure the transparent plastic material to form a transparent layer and to make the transparent layer and the fabric layer jointly form a number of keycap receiving sections; forming a mask layer on a lower surface of the fabric layer; removing a portion of the mask layer and a portion of the fabric layer located within each of the keycap receiving sections to form a number of hollow patterns.

13 Claims, 19 Drawing Sheets

(52) U.S. Cl.
CPC . *H01H 2223/003* (2013.01); *H01H 2223/004* (2013.01); *H01H 2223/044* (2013.01); *H01H 2229/056* (2013.01)

(58) Field of Classification Search
USPC ..... 200/5 A, 302.2
See application file for complete search history.

(56) References Cited

U.S. PATENT DOCUMENTS

| | | | | |
|---|---|---|---|---|
| 10,770,246 | B2 * | 9/2020 | Lai | H01H 13/705 |
| 2007/0165368 | A1 | 7/2007 | Hsu et al. | |
| 2010/0051430 | A1 | 3/2010 | Baller et al. | |
| 2010/0170775 | A1 | 7/2010 | Lee et al. | |
| 2010/0232861 | A1 | 9/2010 | Shibata et al. | |
| 2012/0097511 | A1 | 4/2012 | Liu | |
| 2014/0069792 | A1 | 3/2014 | Bates et al. | |
| 2014/0262715 | A1 | 9/2014 | Lee et al. | |
| 2015/0185862 | A1 * | 7/2015 | Chen | B32B 9/025 361/679.08 |

FOREIGN PATENT DOCUMENTS

| | | | |
|---|---|---|---|
| CN | 103660661 | A | 3/2014 |
| CN | 103677284 | A | 3/2014 |
| JP | 2002216575 | A | 8/2002 |
| JP | 201222473 | A | 2/2012 |
| TW | I320900 | B | 2/2010 |
| TW | 201009866 | A | 3/2010 |
| TW | 201526056 | A | 7/2015 |

OTHER PUBLICATIONS

TW Search Report issued in Notice of Allowance dated Sep. 20, 2017 in Taiwan application No. 106115177.
English language translation of TW Search Report issued in Notice of Allowance dated Sep. 20, 2017 in Taiwan application No. 106115177.
Notice of Allowance dated Sep. 20, 2017 in Taiwan application No. 106115177.
English language translation of Notice of Allowance dated Sep. 20, 2017 in Taiwan application No. 106115177.

* cited by examiner

METHOD FOR FABRICATING KEYBOARD COVERING FILM

This application is a Continuous Application of U.S. application Ser. No. 15/971,021 filed May 4, 2018, now U.S. Pat. No. 10,770,246, which claims the benefit of Taiwan application Serial No. 106115177, filed May 8, 2017, the subject matter of which is incorporated herein by reference.

BACKGROUND OF THE INVENTION

Field of the Invention

The invention relates in general to a keyboard covering protection structure, and more particularly to a keyboard covering film, a waterproof keyboard, a method for fabricating a keyboard covering film, a waterproof keycap assembly and an illuminating keyboard.

Description of the Related Art

The keyboard of an electronic device, such as the keyboard of a notebook computer, is the part through which external moisture easily infiltrate to the inside of the electronic device. External moisture may accidentally infiltrate to an electronic device through the keyboard during everyday use of the electronic device, when the rugged notebook computer is used outdoor, or when the keyboard of the electronic device is cleaned using a cleaning solution (for example, in hospital, the equipment is normally sterilized using alcohol or disinfectant). Besides, the character or symbol printed on a keycap may be worn out or peeled off and become unrecognizable.

Existing design of the waterproof keyboard mainly covers the area of the keyboard with a waterproof film which seals the entire opening for disposing the keyboard. Meanwhile, the waterproof film has a number of concave portions that correspond to the keycaps and make the island structures of the keycaps presented on the waterproof film. The characters can be formed by a printing process or a laser engraving process for the concave pattern. Similarly, the characters formed on the upper surface of the waterproof film are easily worn away. The concave pattern of the characters formed by a laser engraving process may be worn out and become unrecognizable. Furthermore, dirt may easily accumulate in the recess structure of the concave pattern, and create a big problem, for example, for hospitals where cleanliness is held in high regard.

Therefore, how to improve the existing design of waterproof film still a technical issue in the technology field of waterproof keyboard.

SUMMARY OF THE INVENTION

In regard to the above problems, the present invention discloses a method for fabricating a keyboard covering film capable of resolving technical issues of the prior art.

To resolve the above problems, the invention discloses a keyboard covering film including a transparent layer, a fabric layer and a mask layer. The fabric layer is disposed on a lower surface of the transparent layer. The mask layer is disposed on a lower surface of the fabric layer. The transparent layer and the fabric layer are treated by a hot pressing process to form a number of hollow keycap receiving sections. Within each of the keycap receiving sections, portion of the fabric layer and the mask layer are removed to form a hollow pattern, so that a light can penetrate each hollow keycap receiving section by passing through the hollow pattern and the transparent layer.

In at least one embodiment of the present invention, the keyboard covering film further includes a first paint layer coated within the hollow pattern and neighboring to the lower surface of the transparent layer.

The present invention further discloses a waterproof keyboard including a housing, a baseplate, a number of keycaps, a light source and a keyboard covering film. The housing has an opening. The baseplate is disposed within the housing. The keycaps are disposed above the baseplate and located within the opening through which the top surface of each keycap is exposed. The light source is disposed below the plurality of keycaps for emitting a light. The keyboard covering film extends across the opening, and the keyboard covering film includes a transparent layer, a fabric layer and a mask layer. The fabric layer is disposed on a lower surface of the transparent layer. The mask layer is disposed on a lower surface of the fabric layer. The transparent layer and the fabric layer include a number of hollow keycap receiving sections, and each of the keycap receiving sections covers one of the keycaps. Within each of the keycap receiving sections, portion of the fabric layer and the mask layer are removed to form a hollow pattern, so that the light can reach the upper side of the keyboard covering film by passing through the keycap, the hollow pattern and the transparent layer.

In at least one embodiment of the present invention, a second paint layer is disposed on the top surface of at least one of the keycaps, and the second paint is beneath the hollow patterns.

In at least one embodiment of the present invention, a glue is disposed on the top surface of at least one of the keycaps for bonding the keycap to a corresponding one of the keycap receiving sections.

The present invention further discloses a method for fabricating a keyboard covering film. The method includes steps of: coating a transparent plastic material on an upper surface of a fabric layer before the transparent plastic material is cured; treating the fabric layer and the transparent plastic material by a hot press process to cure the transparent plastic material to form a transparent layer and to make the transparent layer and the fabric layer jointly form a number of keycap receiving sections; forming a mask layer on a lower surface of the fabric layer; removing a portion of the mask layer and a portion of the fabric layer located within each of the keycap receiving sections to form a number of hollow patterns.

In at least one embodiment of the present invention, the fabricating method further includes a step of leveling the transparent plastic material and adjusting the coating thickness of the transparent plastic material.

The present invention further discloses a waterproof keycap assembly including a keyboard covering film and a plurality of keycaps. The keyboard covering film includes a fabric layer and a transparent layer disposed on an upper surface of the fabric layer. The transparent layer and the fabric layer are treated by a hot pressing process to form a number of keycap receiving sections. The fabric layer and the keycap receiving sections are located on the same side of the transparent layer. The fabric layer has hollow patterns within each of the keycap receiving section, wherein the hollow patterns are formed by removing a portion of the fabric layer. A mask layer is disposed on at least the top surface of each of the keycaps, each keycap receiving section covers a corresponding one of the keycaps. The hollow patterns of the fabric layer overlap the hollow patterns of the mask layer.

In at least one embodiment of the present invention, the waterproof keycap assembly further includes a second paint layer covering the hollow patterns of the mask layer.

The present invention further discloses an illuminating keyboard including a baseplate, a number of keycaps, a keyboard covering film and a light source. A plurality of keycaps is disposed above the baseplate. The keycaps move upward and downward with respect to the baseplate. Every two adjacent keycaps are separated by a keycap gap. The keyboard covering film includes a mask layer, a fabric layer, a transparent layer and a number of hollow patterns. The keyboard covering film is disposed on the keycaps and extends across the keycap gap. The mask layer is disposed below the fabric layer. The transparent layer is disposed on the fabric layer. Each hollow pattern is disposed above a corresponding one of the keycaps. The hollow patterns penetrate the mask layer and the fabric layer. A light source is disposed on the baseplate for emitting a light, which is projected upwards to penetrate the hollow patterns and the transparent layer and make the hollow patterns recognizable. When the keycaps move upward and downward with respect to the baseplate, the transparent layer and the fabric layer are correspondingly deformed and remain extending across the keycap gap. The transparent layer has a number of press portions. The upper surface of each press portion is flat. Each press portion is disposed above a corresponding one of the keycaps and covers a corresponding one of the hollow patterns.

In at least one embodiment of the present invention, the keyboard covering film further includes a first paint layer disposed within the hollow patterns and in contact with a lower surface of each press portion. The first paint layer changes the light penetrating the hollow patterns and the transparent layer and makes the hollow patterns recognizable.

In at least one embodiment of the present invention, the transparent layer further includes a concave portion disposed between two corresponding adjacent press portions and located above the keycap gap and makes the boundaries of each of the press portions recognizable.

The present invention provides waterproof effect to the keyboard, Moreover, since the hollow patterns are formed on the inner side and will not be worn out by the operation of the keyboard, the symbols and characters represented by the hollow patterns and the transparent layer can remain recognizable over a long period of time. Therefore, the surface of the keyboard covering film is free of concave symbols and characters, and the accumulation of dirt can be effectively avoided. Meanwhile, the present invention uses a fabric layer to enhance the strength of the transparent layer, such that the thickness of the keyboard covering film can be effectively reduced, and the operation interference caused by the keyboard being too thick can be avoided.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
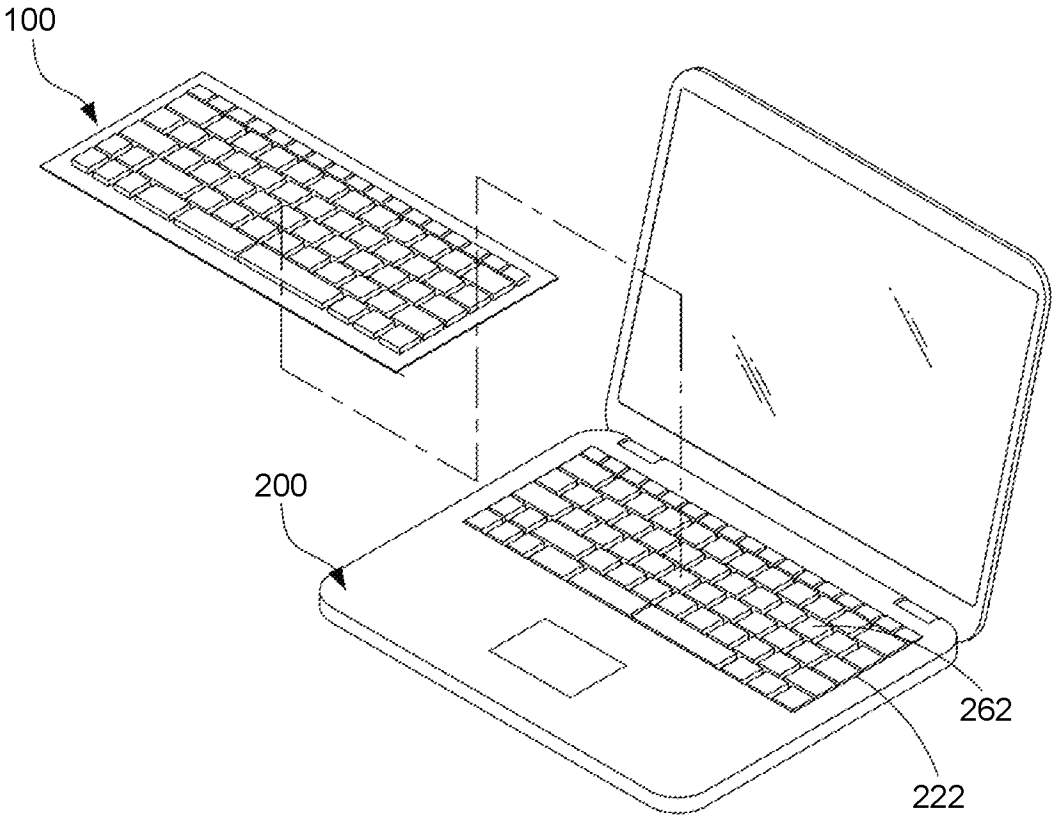
FIG. 1 is a three-dimensional diagram showing the combination relationship between the keyboard covering film and the waterproof keyboard according to a first embodiment of the present invention.

Referring to FIG. 1, a keyboard covering film according to a first embodiment of the present invention is shown. The keyboard covering film is used to cover a key set including a number of keycaps 262 to form a waterproof keyboard 200. The waterproof keyboard can be an independent keyboard device capable of receiving necessary electronic components to form a body of an electronic device, such as the body of the notebook computer as shown in FIG. 1.

Referring to FIG. 2, FIG. 3, FIG. 4 and FIG. 5, a keyboard covering film 100 according to a first embodiment of the present invention is shown. The keyboard covering film 100 includes a fabric layer 120, a transparent layer 140 and a mask layer 160.

Figure 4:
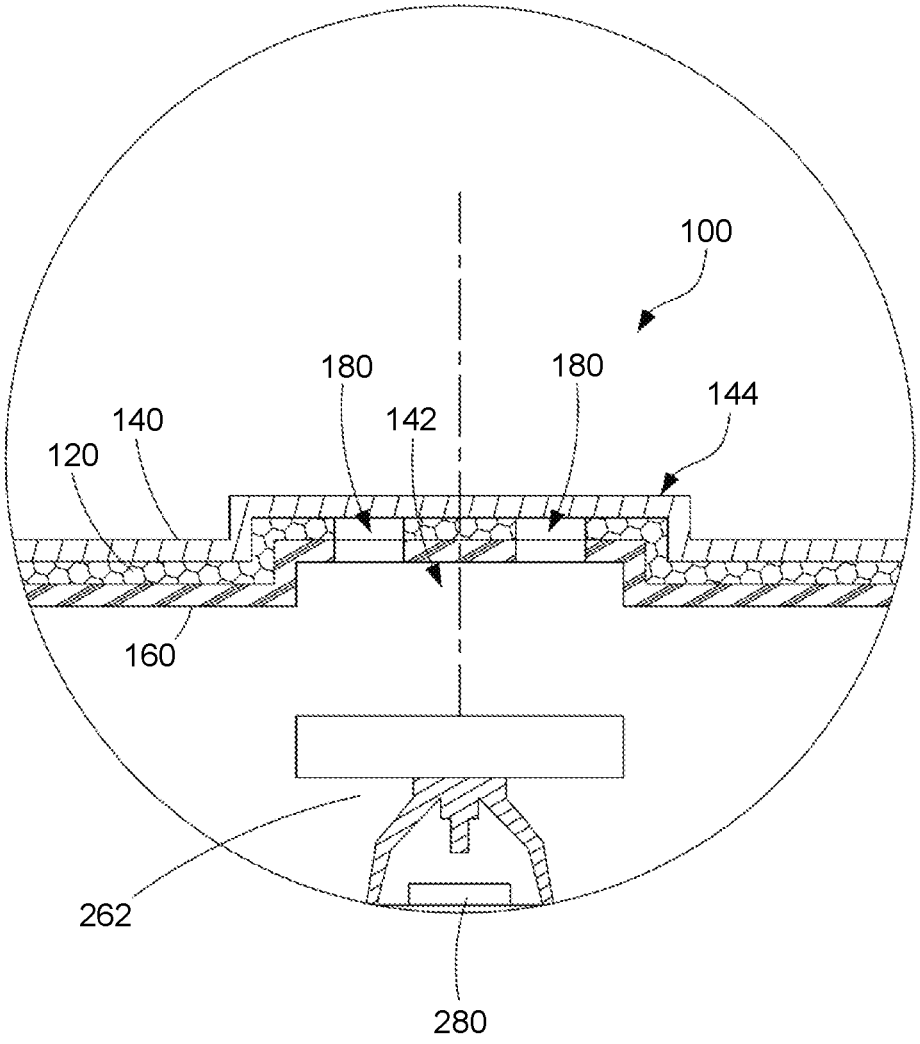
FIG. 4 is a partial enlarged view of FIG. 2.
Figure 5:
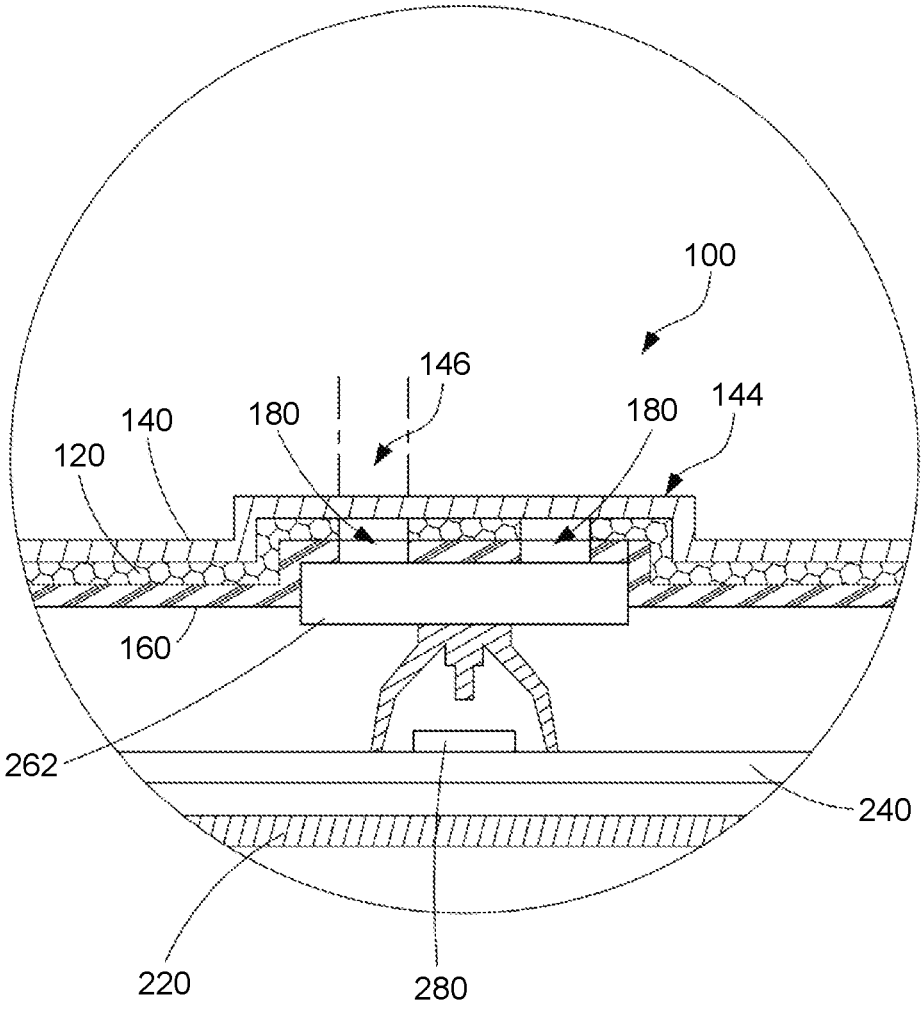
FIG. 5 is a partial enlarged view of FIG. 3.

As shown in FIG. 4 and FIG. 5, the transparent layer 140 is disposed on an upper surface of the fabric layer 120, and a waterproof protection structure is formed on the upper surface of the fabric layer 120 to provide flexible deformation effect. That is, the fabric layer 120 is disposed on a lower surface of the transparent layer 140. The material of transparent layer 140 can be silicone and is not limited thereto, and the material of transparent layer 140 can also be any soft and waterproof plastic material. The plastic material is coated on the upper surface of the fabric layer 120 before the plastic material is cured. The plastic material coated on the upper surface of the fabric layer 120 can be cured to form a transparent layer 140 disposed on an upper surface of the fabric layer 120. The transparent layer 140 may have a white color. The transparent layer 140 can be incorporated with a pigment to display a specified color, but its performance in transparence must be taken into consideration to assure that sufficient transparence can be maintained.

As shown in FIG. 4 and FIG. 5, the fabric layer 120 can be used as a reinforcement to enhance the strength of the transparent layer 140 and avoid the crack of the transparent layer 140 when pulled. The fabric layer 120 can be formed of a non-woven or a woven cloth which is relatively cheaper. The fabric layer 120 can be formed of various natural fibers such as cotton, linen, and silk or can be formed of man-made fibers such as polyester, nylon, and spandex.

As shown in FIG. 4 and FIG. 5, the mask layer 160 is disposed on a lower surface of the fabric layer 120 and can be formed of an opaque dark ink or a black ink coated or sprayed on the lower surface of the fabric layer 120. The mask layer 160 mainly shields the lower surface of the fabric layer 120 to make the fabric layer 120 opaque to the light.

Figure 2:
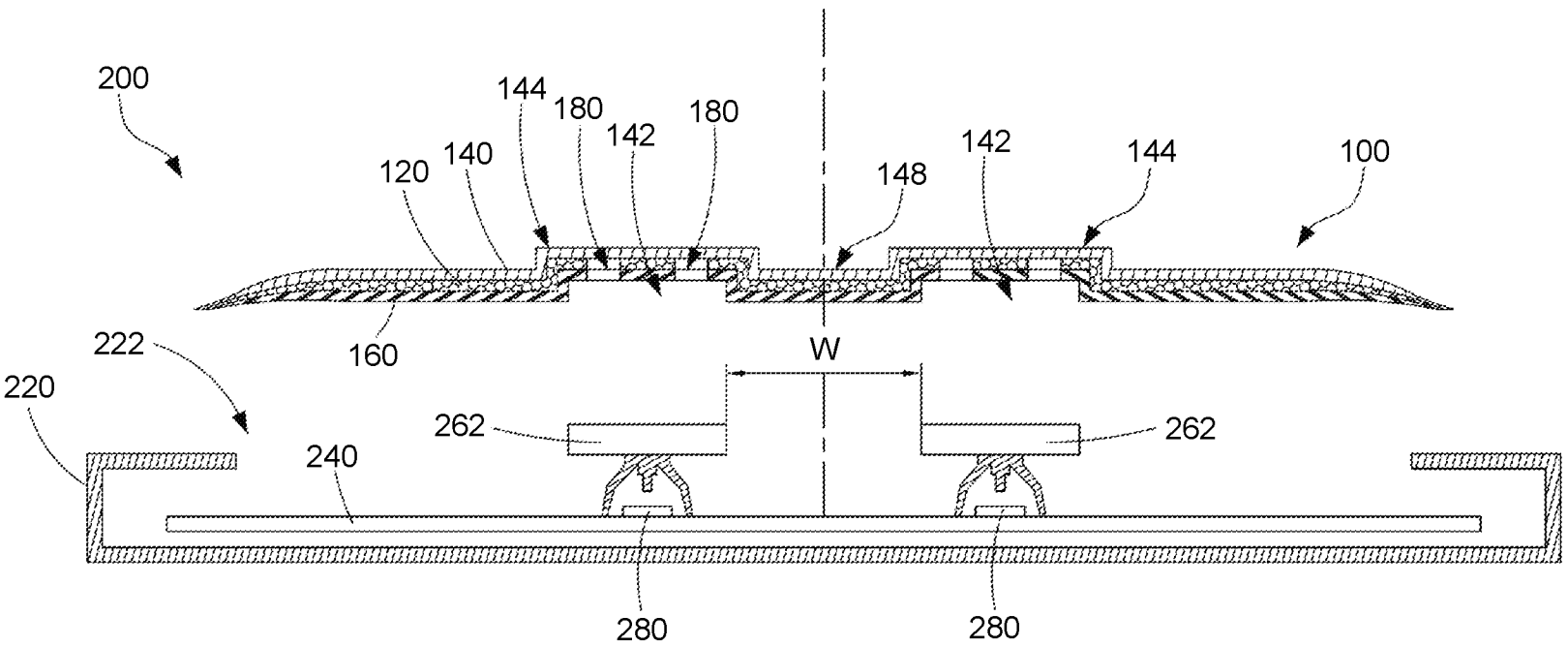
FIG. 2 is an explosion diagram of a cross section according to a first embodiment of the present invention.

As shown in FIG. 2 and FIG. 4, the transparent layer 140 and the fabric layer 120 are treated by a hot pressing process to form a plurality of hollow keycap receiving sections 142 recessed to the lower surface of the fabric layer 120. The mask layer 160 is further disposed on a lower surface of the fabric layer 120. Therefore, the fabric layer 120, the mask layer 160 and the keycap receiving sections 142 are located on the same side of the transparent layer 140. The keycap receiving sections 142 can have different shapes and sizes.

Figure 3:
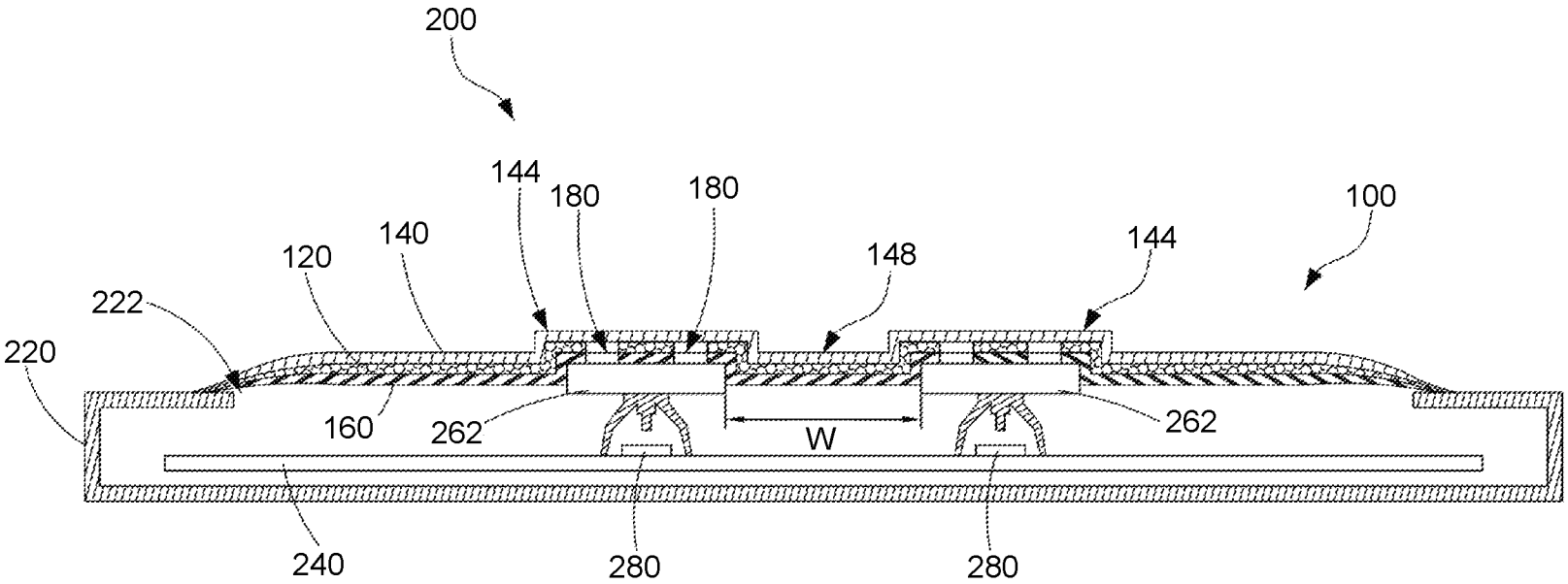
FIG. 3 is a cross-sectional view according to a first embodiment of the present invention.

As shown in FIG. 1, FIG. 3 and FIG. 5, the shape, size and disposition of the keycap receiving sections 142 correspond to that of the keycaps 262, such that each keycap receiving section 142 can receive and cover a corresponding keycap 262 and the top surface of the corresponding keycap 262 can face the keyboard covering film 100.

As shown in FIG. 4 and FIG. 5, the fabric layer 120 and the mask layer 160 are treated by an etching process to form hollow patterns within each keycap receiving section 142, wherein the hollow patterns are formed by removing a portion of the fabric layer and the mask layer. The hollow patterns 180 correspond to the characters or symbols of the keycaps 262. Exemplarily but not restrictively, the etching process is a laser engraving process. Thus, when a light is emitted from a lower surface of the keyboard covering film 100 (that is, the lower surface of the fabric layer 120), the light will be shielded by the mask layer 160 and can only pass through the hollow patterns 180 and then penetrate the transparent layer 140 to display illuminating transparent patterns 146 on an upper surface of the keyboard covering film 100 (that is, the upper surface of the transparent layer 140). The shapes of the transparent patterns 146 correspond to that of the hollow patterns 180.

As shown in FIG. 1, FIG. 2 and FIG. 3, a waterproof keyboard 200 according to a first embodiment of the present invention is shown. The waterproof keyboard 200 includes a housing 220, a baseplate 240, a number of keycaps 262, at least one light source 280, and the keyboard covering film 100 disclosed above. The waterproof keyboard 200 can be an independent keyboard device or a keyboard capable of receiving necessary electronic components to form a body of an electronic device, such as the body of the notebook computer.

As shown in FIG. 1, FIG. 2 and FIG. 3, the housing 220 has an opening 222. The baseplate 240 is disposed within the housing 220. The keycaps 262 are disposed above the baseplate 240 and located within the opening 222. The top surface of each keycap 262 is exposed through the opening 222 and slightly protruded above the surface of the housing 220. At least the top surface of the keycap 262 is transparent to the light.

As shown in FIG. 2 and FIG. 3, at least one light source 280 is disposed within the housing 220 and below the keycaps. The light sources 280 can be disposed on the baseplate 240 or at other position in the housing 220. Each light source 280 is used to emit a light, which is projected towards the keycap 262 in the opening 222 or towards other position inside the housing 220. Then, the light is uniformed through refraction or reflection and then is projected to the keycaps 262 located within the opening 222. The baseplate 240 can be a printed circuit board, a flexible print circuit (FPC) of a thin-film keyboard, or an ordinary carrier without any circuits. The light sources 280 can be light-emitting diodes, small bulbs, small cold cathode tubes or cold light components. The light sources 280 are disposed in correspondence to the keycaps 262, that is, each light source 280 is disposed in correspondence to one keycap 262 and located below the corresponding keycap 262. The light sources 280 can also be uniformly disposed on the baseplate 240, and the quantity and positions of the light sources 280 may not correspond to that of the keycaps 262. The light emitted by each light source 280 is guided by a light guide plate or a light uniform plate (not shown), such that each keycap 262 can be uniformly irradiated by the light. The keyboard covering film 100 extends across the opening 222 and seals the opening 222 and each keycap receiving section 142 covers a corresponding keycap 262, such that each hollow pattern 180 is located on the top surface of the corresponding keycap 262.

As shown in FIG. 1, FIG. 3 and FIG. 5, the keyboard covering film 100 seals the opening 222 and therefore avoids moisture infiltrating the waterproof keyboard 200 through the opening 222 or the gap between every two adjacent keycaps 262. The light emitted by the light source 280 will be shielded by the mask layer 160 and can only pass through the hollow patterns 180 and then penetrate the transparent layer 140 to display illuminating transparent patterns 146 on the upper surface of the keyboard covering film 100 (that is, the upper surface of the transparent layer 140), and make it easier for the user to recognize different keycaps 262.

As shown in FIG. 1 to FIG. 5, regardless whether the keyboard covering film 100 seals the opening 222 or not, a keyboard covering film 100, a number of keycaps 262 and a number of light sources 280 can form an illuminating keyboard. The illuminating keyboard includes a baseplate 240, a number of keycaps 262, a keyboard covering film 100 and at least one light source 280. The keycaps 262 are disposed above the baseplate 240, and can move upward and downward with respect to the baseplate 240 through an elastic mechanism or a restoring mechanism. Every two adjacent keycaps 262 are separated by a keycap gap W to assure that the keycaps 262 will not interfere with each other. To make the keycap gap W be clearly shown, the keycap gap W of FIG. 2 and FIG. 3 is enlarged and is not according to the scale of FIG. 1.

As shown in FIG. 2 and FIG. 3, the keyboard covering film 100 is disposed on the keycaps 262 and extends across the keycap gaps W. The mask layer 160 is disposed below he fabric layer 120. The transparent layer 140 is disposed on the fabric layer 120. Each hollow pattern 180 is disposed above the corresponding keycap 262 and penetrates the mask layer 160 and the fabric layer 120. The transparent layer 140 has a number of press portions 144 and concave portions 148. The upper surface of each press portion 144 is flat, and each press portion 144 is disposed above a corresponding keycap 262 and covers the corresponding hollow pattern 180. Each of the concave portions 148 is disposed between two corresponding adjacent press portions 144 and located above a gap between two corresponding adjacent keycaps 262 and each of the concave portions 148 makes the boundaries of each press portion 144 recognizable.

As shown in FIG. 2, FIG. 3, FIG. 4 and FIG. 5, at least one light source 280 is disposed on the baseplate 240. Each light source 280 is used to emit a light, which is directly projected upwards hollow patterns 208 or is indirectly refracted or reflected upwards to penetrate the hollow patterns 208 and the transparent layer 140 and make the hollow patterns 208 recognizable from the position above the transparent layer 140. The transparent layer 140 and the fabric layer 120 can be flexibly deformed. When the keycaps 262 move upward and downward with respect to the baseplate 240, the transparent layer 140 and the fabric layer 120 will be correspondingly deformed and remain extending across the keycap gap W.

The hollow patterns 180 can be formed by treating an etching process, such as a laser engraving process, on an inner surface of the keyboard covering film 100. Therefore, the press portions 144 of the transparent layer 140 are free of concave symbols and characters, and the accumulation of dirt can be effectively avoided.

Figure 6:
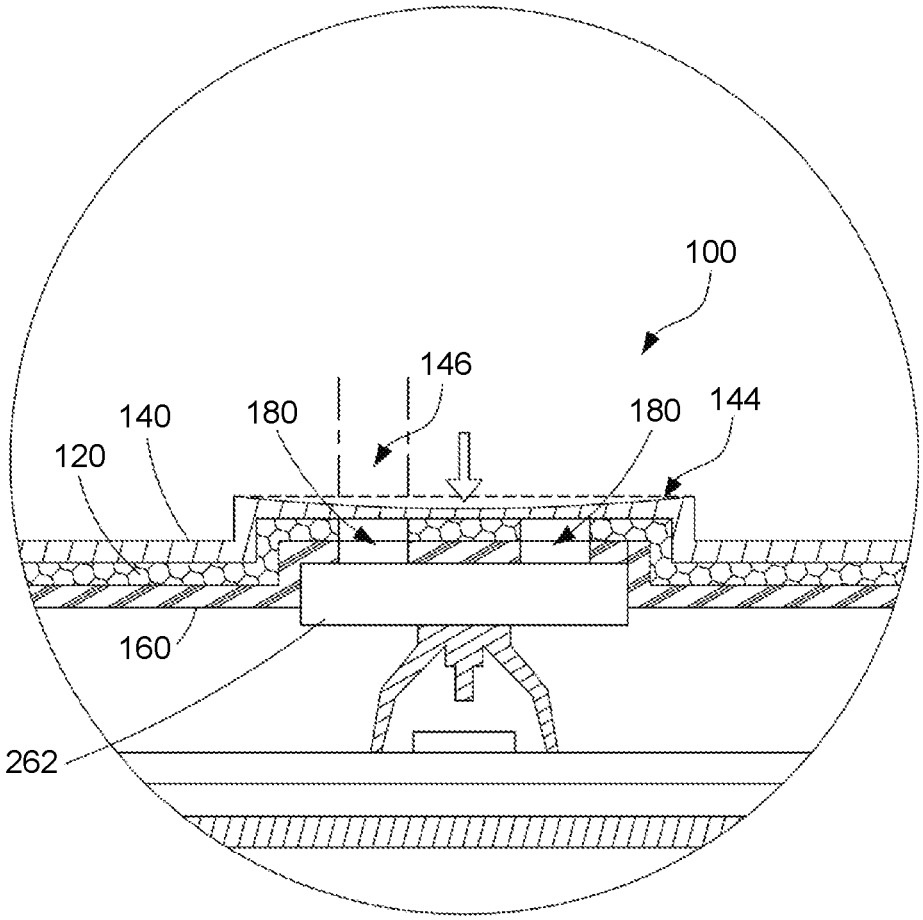
FIG. 6 is a partial view of a cross section showing the state of long-term wearing out according to a first embodiment of the present invention.

As shown in FIG. 6, after the keyboard covering film 100 is operated over a long period of time, the transparent layer 140 will inevitably be worn out. The press portion 144 on the back of the keycap 262 is thinned but the surface still remains flat. Since the fabric layer 120 and the mask layer 160 having the hollow patterns 180 are not directly worn out, the display effect of the hollow patterns 180 and the transparent patterns 146 is not affected, and the symbols and characters represented by the hollow patterns 180 and the transparent patterns 146 can remain recognizable over a long period of time. Besides, the present invention uses the fabric layer 120 to enhance the strength of the transparent layer 140, such that the thickness of the keyboard covering film 100 can be effectively reduced, and the operation interference caused by the keyboard being too thick can be avoided.

Figure 7:
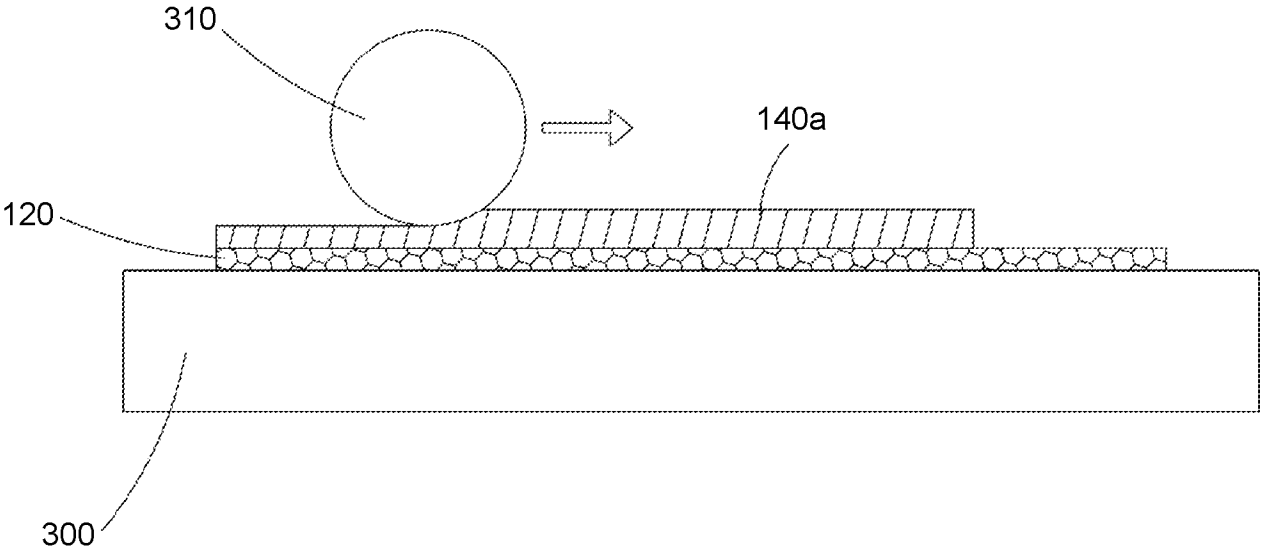
FIG. 7 to FIG. 12 shows the method for fabricating a keyboard covering film of the present invention.
Figure 8:
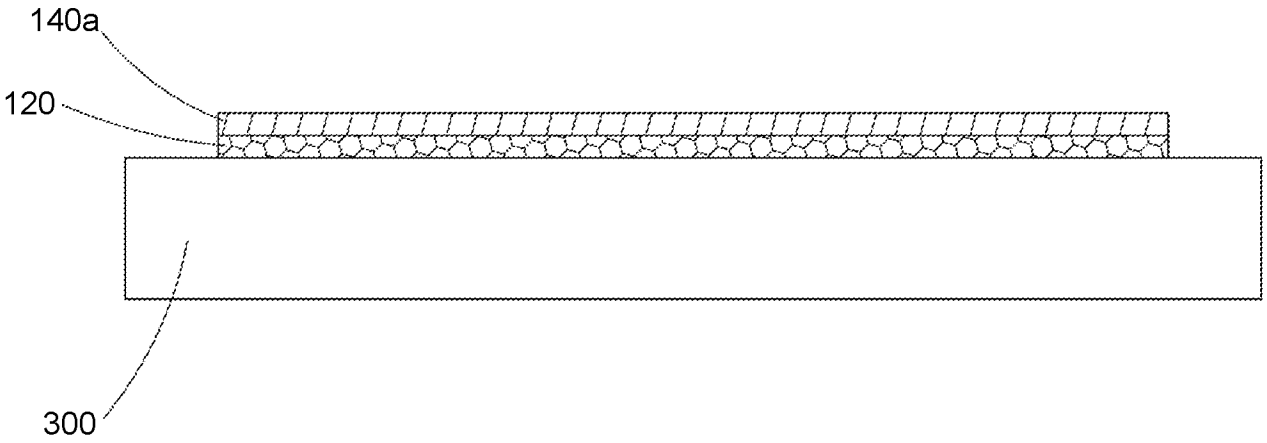
Figure 13:
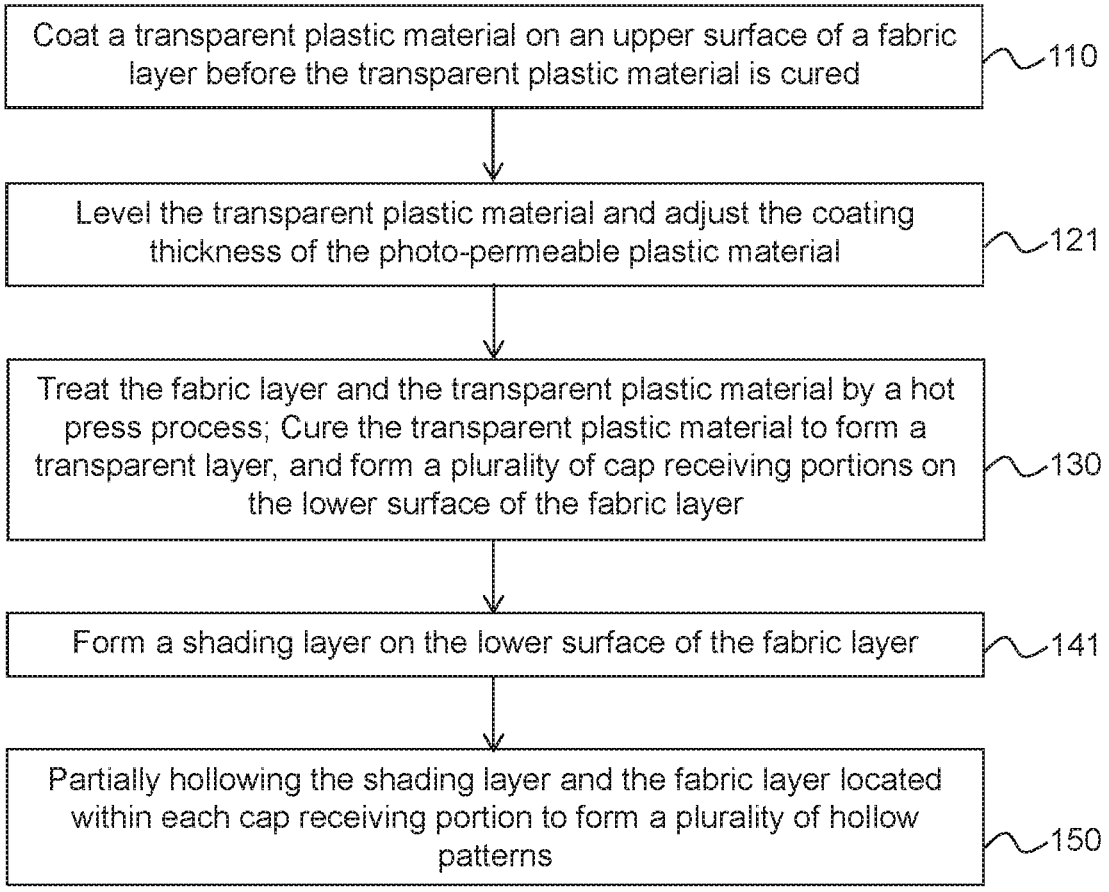
FIG. 13 is a flowchart of the method for fabricating a keyboard covering film of the present invention.

Refer to FIG. 7, FIG. 8 and FIG. 13, the method for fabricating a keyboard covering film 100 of the present invention is shown. Firstly, a fabric layer 120 is placed on a carrying platform 300, and a transparent plastic material 140*a* is coated on an upper surface of the fabric layer 120 before the transparent plastic material is cured (Step 110). Then, a leveling tool 310 is used to level the transparent plastic material 140*a* and adjust the coating thickness of the transparent plastic material 140*a* (Step 121).

Figure 9:
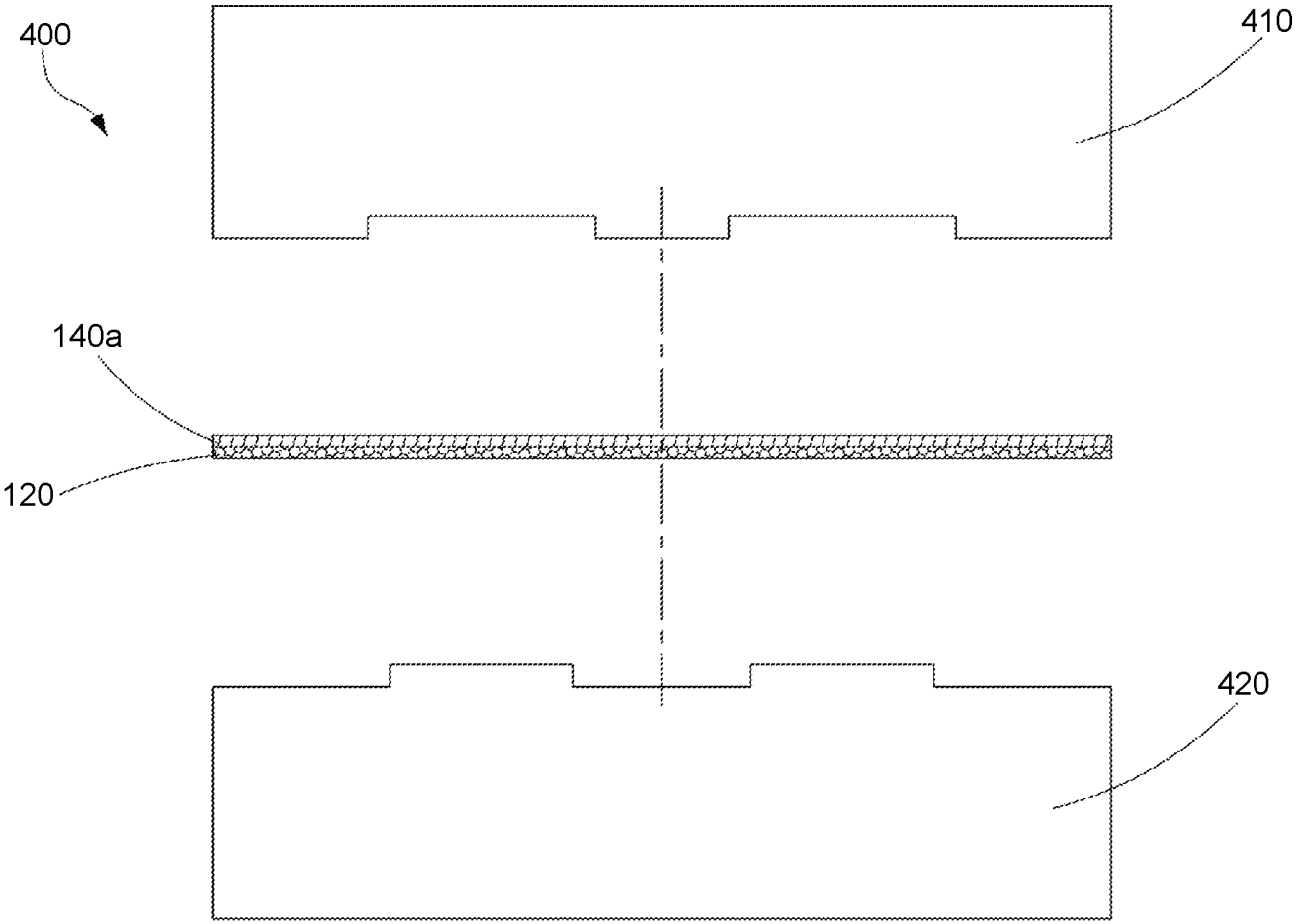
Figure 10:
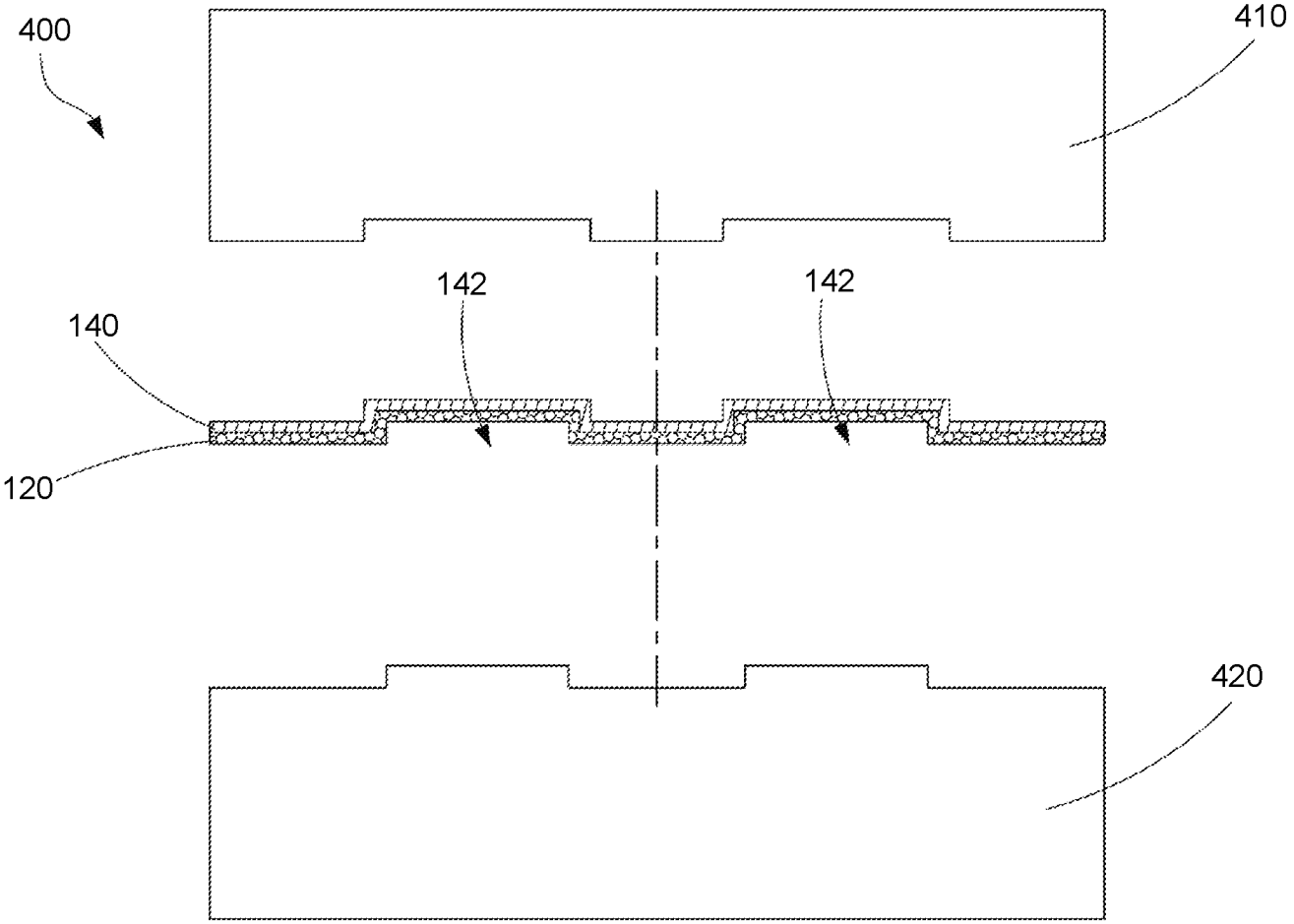

As shown in FIG. 9, FIG. 10 and FIG. 13, the fabric layer 120 together with the transparent plastic material 140*a* are placed into a heating mold 400 and treated by a hot press process (Step 130). That is, when the transparent plastic material 140*a* is cured and molded by the hot press process, the shape of the fabric layer 120 also changes at the same time, and the transparent plastic material 140*a* is cured to form a transparent layer 140 on an upper surface of the fabric layer 120 and form a number of keycap receiving sections 142 on the transparent layer 140 and the fabric layer 120. The keycap receiving sections 142 are recessed to the lower surface of the fabric layer 120. The fabric layer 120 and the keycap receiving sections 142 are located on the same side of the transparent layer 140.

In an example as shown in FIG. 9 and FIG. 10, the heating mold 400 includes an upper mold 410 and a lower mold 420. The upper mold 410 has a concave portion, the lower mold 420 has a convex portion matching the concave portion, and the contour of the convex portion is similar to the contour of the keycap 262. That is, the contour of the convex portion is similar to that of the keycap receiving section 142. The concave portion is matched with the thickness of the fabric layer 120 plus the thickness of the transparent layer 140 and is slightly larger than the convex portion. The transparent plastic material 140*a* and the fabric layer 120 are disposed between the upper mold 410 and the lower mold 420. The fabric layer 120 faces the lower mold 420, and the transparent plastic material 140*a* faces the upper mold 410. After the upper mold 410 and the lower mold 420 are mold aligned and heated, the transparent plastic material 140*a* can be cured to form a transparent layer 140 on the upper surface of the fabric layer 120 and at the same time form a number of keycap receiving sections 142 on the transparent layer 140 and the fabric layer 120. After the transparent layer 140 cools, the keycap receiving sections 142 will be molded.

Figure 11:
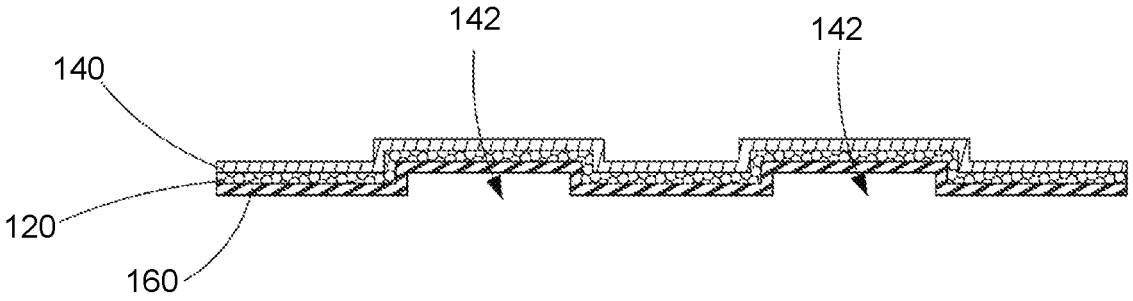

Referring to FIG. 11 and FIG. 13, the lower surface of the fabric layer 120 is coated with an ink to form a mask layer 160 (Step 141).

Figure 12:
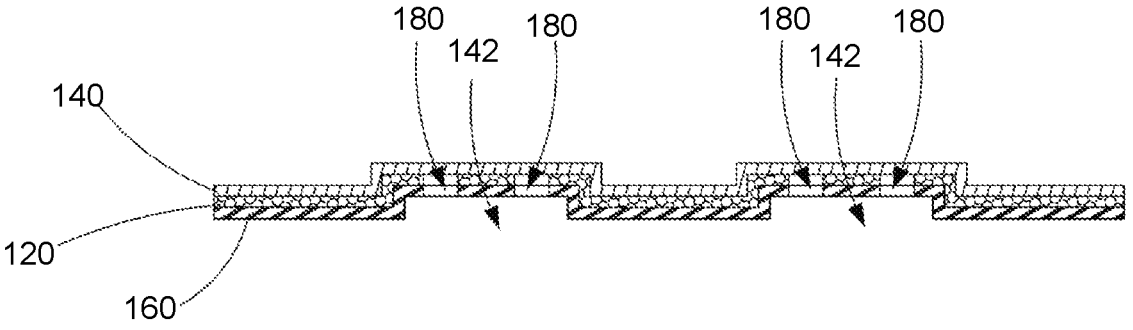

Refer to FIG. 12 and FIG. 13. Lastly, the mask layer 160 and the fabric layer 120 are treated by a laser engraving process in which the mask layer 160 and the fabric layer 120 are partially hollowed to form a number of hollow patterns 180 (Step 150).

The display color of the hollow patterns 180 can be controlled by the color of the light source 280 or the color incorporated in the transparent layer 140. A specified color can be displayed through special treatment.

Figure 14:
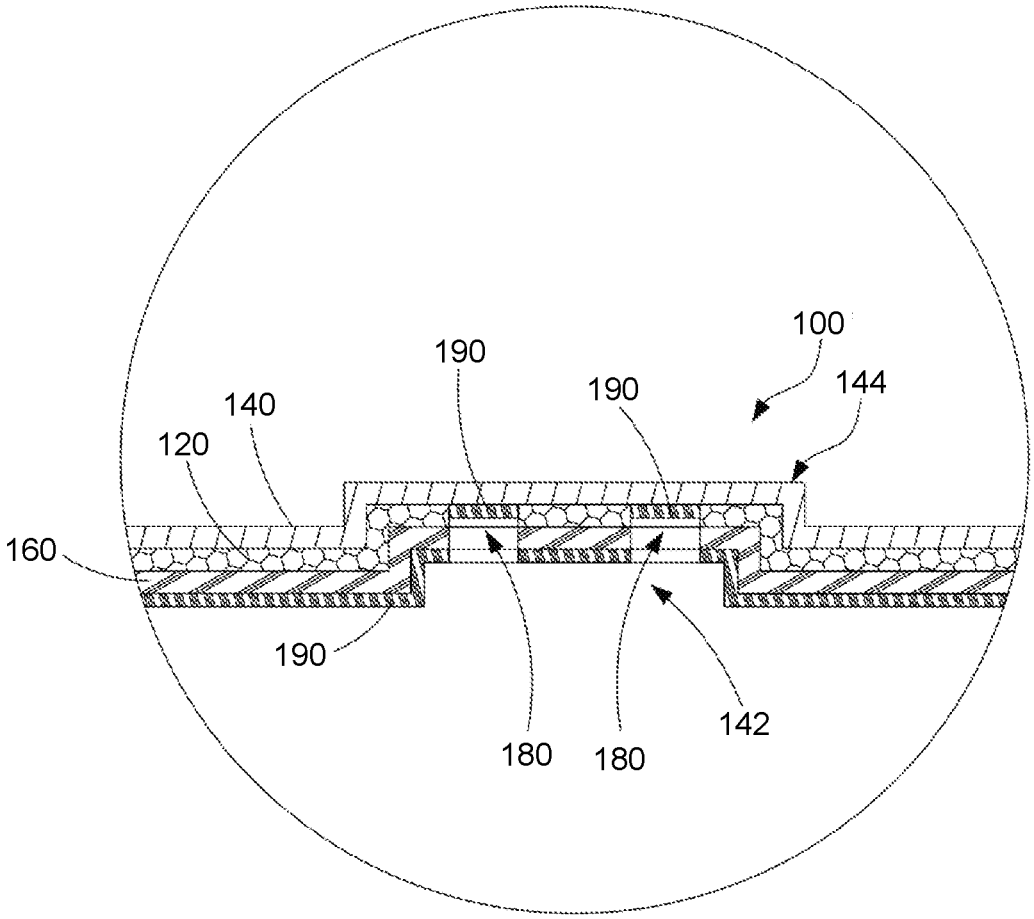
FIG. 14 is a partial view of a cross section according to a second embodiment of the present invention.

Referring to FIG. 14, a keyboard covering film 100 according to a second embodiment of the present invention is shown. The composition of the keyboard covering film 100 of the second embodiment is substantially identical to the composition of the keyboard covering film 100 of the first embodiment. The composition of the keyboard covering film 100 of the second embodiment includes the fabric layer 120, the transparent layer 140, and the mask layer 160. The disposition of each layer of the second embodiment is substantially similar to that of the first embodiment, and the similarities are not repeated here.

The keyboard covering film 100 of the second embodiment further includes a first paint layer 190 coated on the hollow patterns 180 through an inner side of the keyboard covering film 100 and in contact with a lower surface of a number of press portions 144. In practical operation, since the first paint layer 190 is directly coated on the inner side of the keyboard covering film 100, the first paint layer 190 may extend out of the hollow patterns 180 and covers the lower surface of the mask layer 160, The main purpose is to fill a light-color pigment into the hollow patterns 180 and coated on the lower surface of the transparent layer 140, The first paint layer 190 is mainly formed of an ink through which most of the light can be transmitted, The first paint layer 190 changes the color of the light penetrating the hollow patterns 180 and the transparent layer 140 to display the hollow patterns 180 with a specified color on the upper surface of the transparent layer 140 and make the hollow patterns 180 recognizable.

Figure 15:
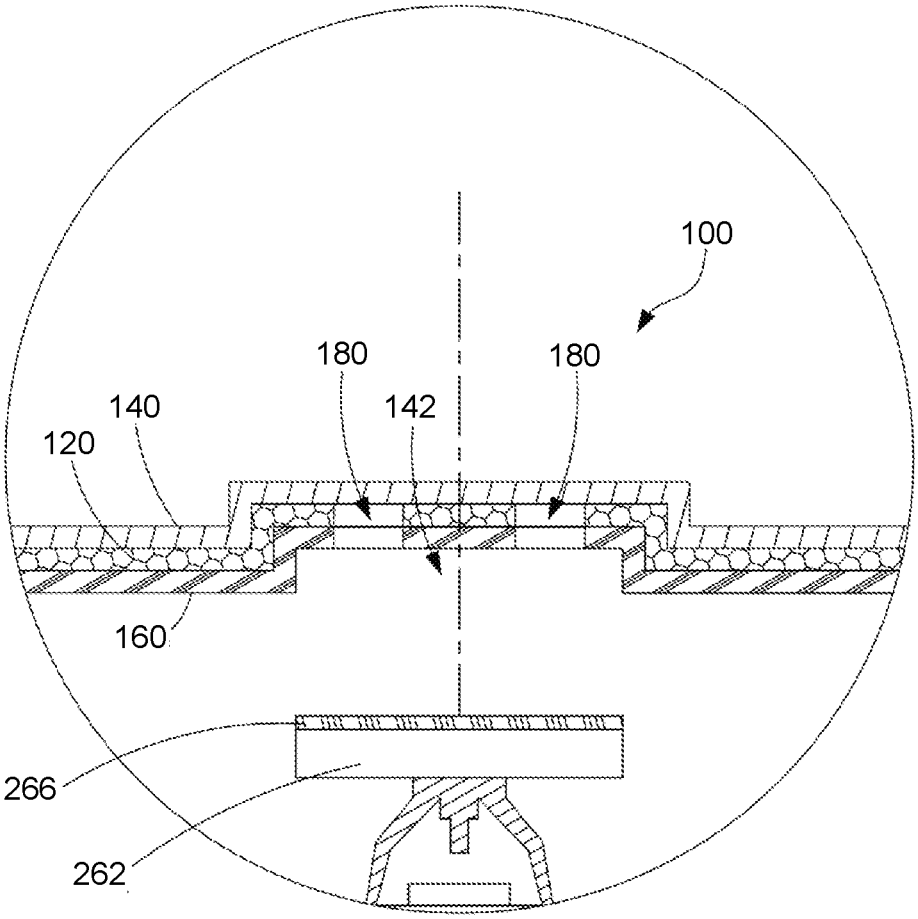
FIG. 15 is an explosion diagram of a partial cross section according to a third embodiment of the present invention.
Figure 16:
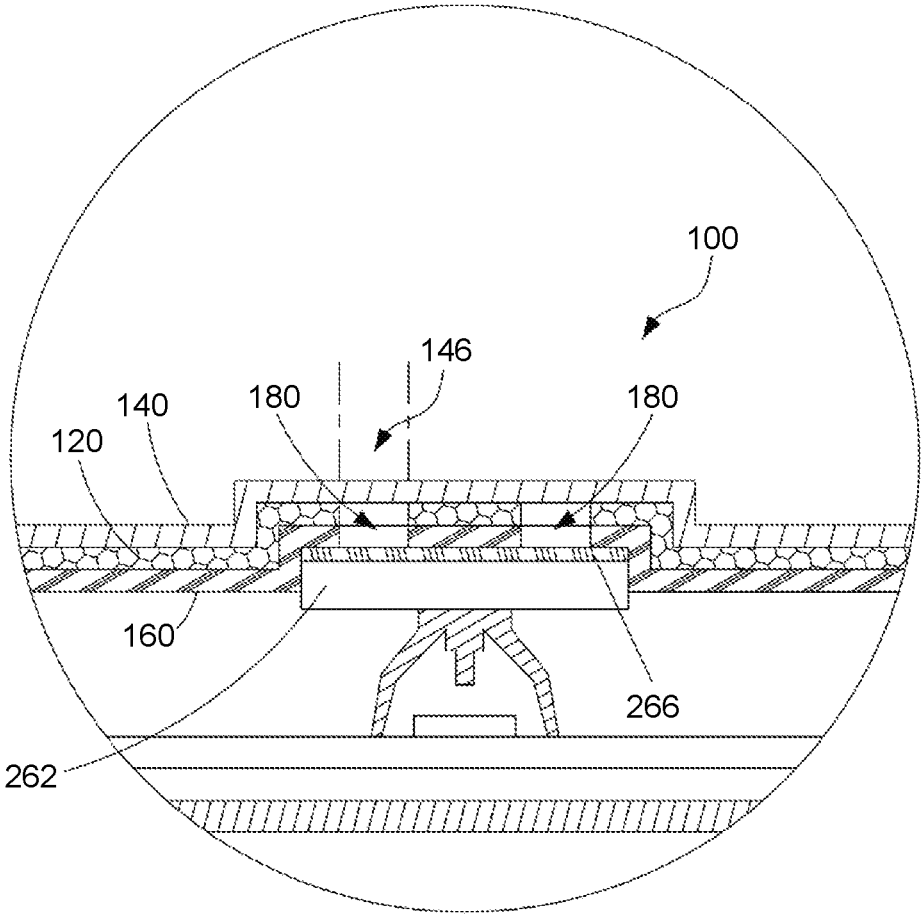
FIG. 16 is a partial view of a cross section according to a third embodiment of the present invention.

Referring to FIG. 15 and FIG. 16, a keyboard waterproof assembly according to a third embodiment of the present invention is shown. The keyboard waterproof assembly includes a keyboard covering film 100 and a number of keycaps 262.

The composition of the keyboard covering film 100 of the third embodiment of the present invention is substantially similar to the composition of the keyboard covering film 100 of the first embodiment. The composition of the keyboard covering film 100 of the third embodiment includes a fabric layer 120, a transparent layer 140, and a mask layer 160. The disposition of each layer of the third embodiment is substantially similar to that of the first embodiment, and the similarities are not repeated here. In the third embodiment, the part of the top surface of each keycap 262 corresponding to a hollow pattern 180 is dyed. That is, the top surface of each keycap 262 is at least partially coated with a second paint layer 266, such that the second paint layer 266 overlaps the corresponding hollow pattern 180. The second paint layer 266 is mainly formed of an ink through which most of the light can be transmitted, such that the light will display a specified color after passing through the keycap 262 and lastly display the transparent patterns 146 with a specified color on the upper surface of the transparent layer 140.

Figure 17:
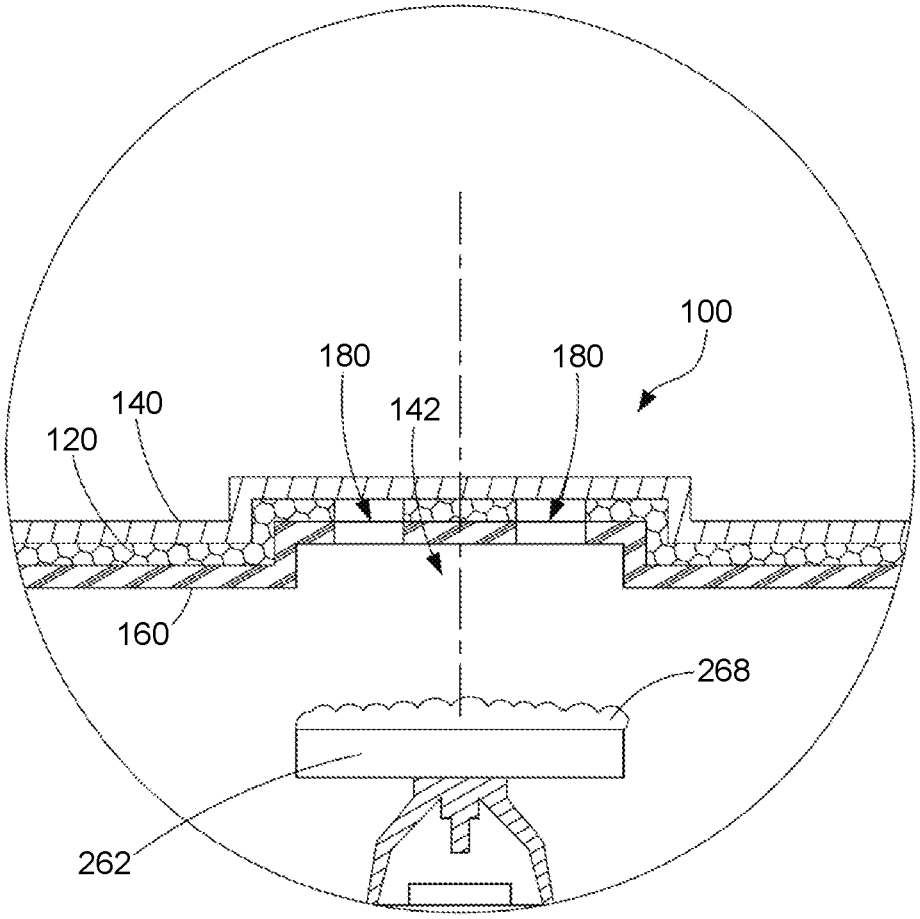
FIG. 17 is an explosion diagram of a partial cross section according to a fourth embodiment of the present invention.
Figure 18:
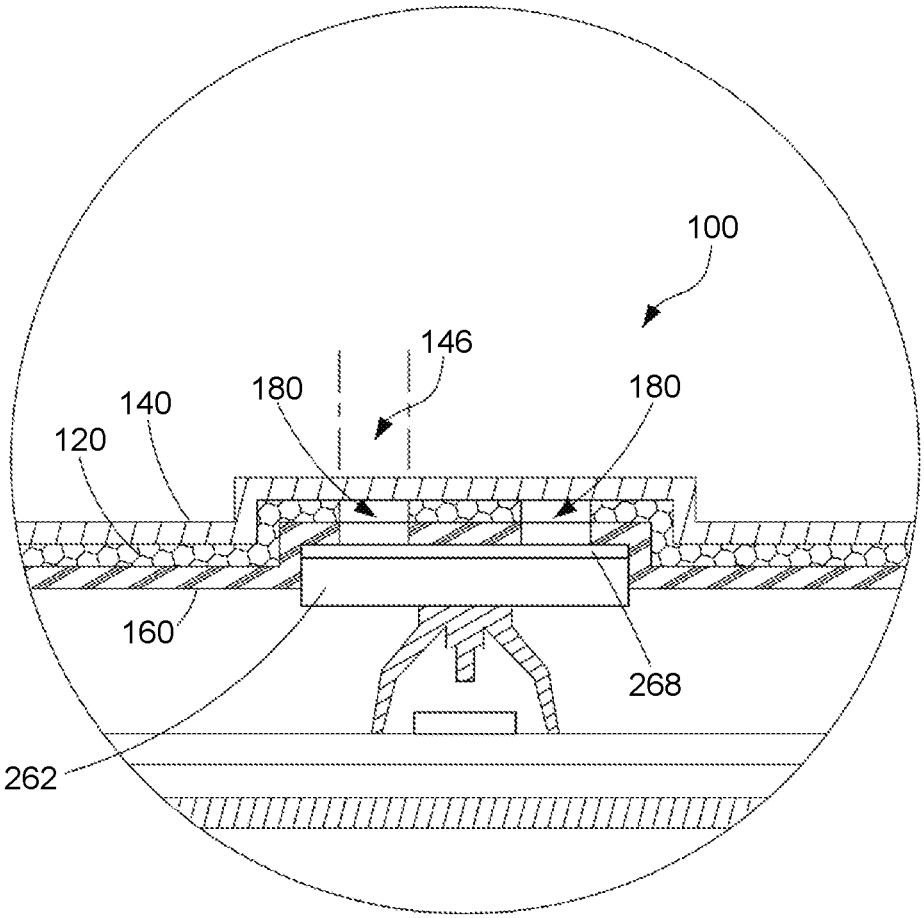
FIG. 18 is a partial view of a cross section according to a fourth embodiment of the present invention.

Referring to FIG. 17 and FIG. 18, a keyboard waterproof assembly according to a fourth embodiment of the present invention is shown. The keyboard waterproof assembly includes a keyboard covering film 100 and a number of keycaps 262.

The composition of the keyboard covering film 100 of the fourth embodiment of the present invention is substantially similar to the composition of the keyboard covering film 100 of the third embodiment. The composition of the keyboard covering film 100 of the fourth embodiment includes a fabric layer 120, a transparent layer 140 and a mask layer 160. The disposition of each layer of the third embodiment is substantially similar to that of the first embodiment, and the similarities are not repeated here. In the fourth embodiment, the top surface of each keycap 262 is coated with a glue 268, such as a hot melt adhesive. The glue has a white color or a non-transparent color. The non-transparent color mainly is light colored. The glue 268 is used to bond the keycap 262 onto the keycap receiving section 142, such that the light after passing through the keycap 262 can display a specified color because of the glue 268 and lastly display the transparent patterns 146 with a specified color on the upper surface of the transparent layer 140.

Figure 19:
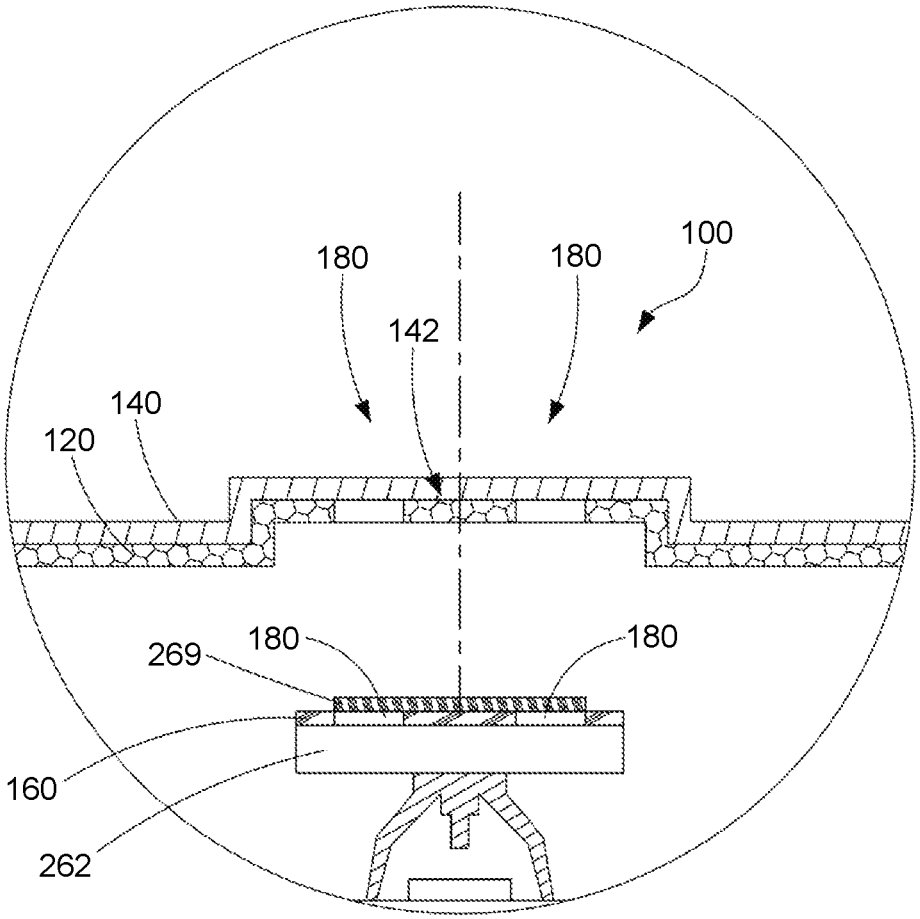
FIG. 19 is an explosion diagram of a partial cross section according to a fifth embodiment of the present invention.
Figure 20:
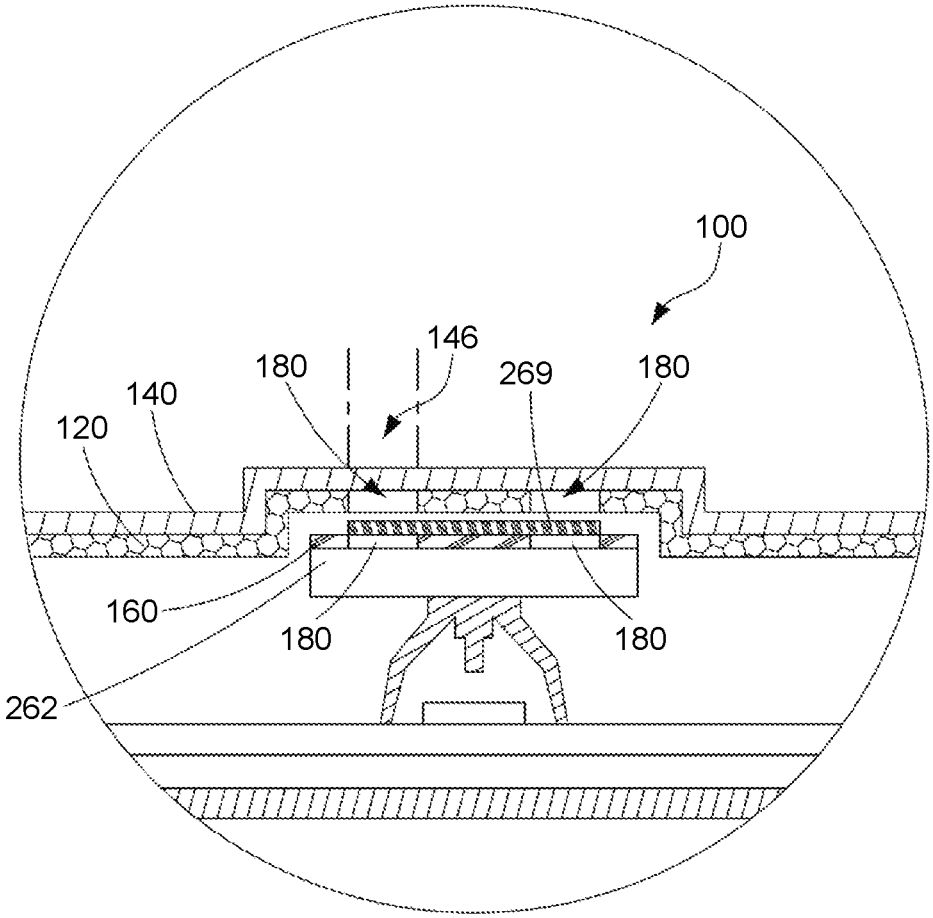
FIG. 20 is a partial view of a cross section according to a fifth embodiment of the present invention.

Referring to FIG. 19 and FIG. 20, a waterproof keycap assembly according to a fifth embodiment of the present invention is shown. The waterproof keycap assembly includes a keyboard covering film 100 and a number of keycaps 262. In the fifth embodiment, the keyboard covering film 100 dispenses with the mask layer 160, and only includes a fabric layer 120 and a transparent layer 140 coated on the upper surface of the fabric layer 120. Similarly, the hollow patterns 180 are formed on the fabric layer 120 by an etching process.

In the fifth embodiment, at least the top surface of the keycap 262 is processed with a light shielding treatment, that is, a mask layer 160 is disposed on at least the top surface of each keycap 262. The mask layer 160 can be a thin film opaque to the light and the mask layer 160 is attached on the top surface of the keycap 262, or the mask layer 160 can be formed of an ink opaque to the light and coated, sprayed or printed on the top surface of each keycap 262. Also, a number of hollow patterns 180 are formed on the mask layer 160.

A first paint layer 269 can be coated on the hollow patterns 180 of the mask layer 160, such that the hollow patterns 180 can be displayed with a specified color. The first paint layer 269 only needs to cover the hollow patterns 180 of the mask layer 160 instead of the entire mask layer 160 on the top surface of the keycap 262.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for fabricating a keyboard covering film, comprising steps of:

coating a transparent plastic material on an upper surface of a fabric layer before the transparent plastic material is cured;

treating the fabric layer and the transparent plastic material by a hot press process to cure the transparent plastic material to form a transparent layer, and to make the transparent layer and the fabric layer jointly form a plurality of keycap receiving sections;

forming a mask layer on a lower surface of the fabric layer; and removing a portion of the mask layer and a portion of the fabric layer located within each of the keycap receiving sections to form a plurality of hollow patterns.

2. The method for fabricating a keyboard covering film according to claim 1, further comprising a step of leveling the transparent plastic material and adjusting a coating thickness of the transparent plastic material.

3. The method for fabricating a keyboard covering film according to claim 1, further comprising a step of coating a paint layer within the hollow patterns and in contact with the lower surface of the transparent layer.

4. The method for fabricating a keyboard covering film according to claim 3, wherein the paint layer extends out of the hollow pattern and covers a lower surface of the mask layer.

5. The method for fabricating a keyboard covering film according to claim 1, wherein a paint layer is disposed on at least one portion of a top surface of keycaps, and the paint layer is corresponding to the hollow patterns.

6. The method for fabricating a keyboard covering film according to claim 1, wherein a glue is disposed on a top surface of keycaps for bonding one of the keycaps to a corresponding one of the keycap receiving sections.

7. The method for fabricating a keyboard covering film according to claim 6, wherein the glue has a white color or a non-transparent color.

8. The method for fabricating a keyboard covering film according to claim 1, wherein two adjacent keycaps are separated by a keycap gap, and one of the hollow patterns is disposed above a corresponding one of the two adjacent keycaps.

9. The method for fabricating a keyboard covering film according to claim 8, wherein the keyboard covering film is disposed on the keycaps and extends across the keycap gap.

10. The method for fabricating a keyboard covering film according to claim 9, wherein the transparent layer and the fabric layer are deformable and remain extending across the keycap gap when the keyboard covering film is pressed.

11. The method for fabricating a keyboard covering film according to claim 8, wherein the transparent layer has a plurality of press portions, an upper surface of each of the press portions is flat, and each press portion is disposed above a corresponding one of the keycaps and covers a corresponding one of the hollow patterns.

12. The method for fabricating a keyboard covering film according to claim 11, wherein the transparent layer further comprises a concave portion disposed between two corresponding adjacent press portions and located above the keycap gap and makes the boundaries of each of the press portions recognizable.

13. The method for fabricating a keyboard covering film according to claim 8, wherein a top surface of each keycap is coated with a glue for bonding each keycap to a corresponding one of the keycap receiving sections, and the glue has a white color or a non-transparent color.

* * * * *